US008259967B2

(12) United States Patent
Feng et al.

(10) Patent No.: US 8,259,967 B2
(45) **Date of Patent: *Sep. 4, 2012**

(54) THERMOACOUSTIC DEVICE

(75) Inventors: Chen Feng, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 348 days.

This patent is subject to a terminal disclaimer.

(21) Appl. No.: 12/589,462

(22) Filed: Oct. 22, 2009

(65) Prior Publication Data

US 2010/0046774 A1 Feb. 25, 2010

Related U.S. Application Data

(63) Continuation-in-part of application No. 12/387,089, filed on Apr. 28, 2009, now Pat. No. 8,068,624.

(30) Foreign Application Priority Data

| | | |
|---|---|---|
| Apr. 28, 2008 | (CN) | 2008 1 0066693 |
| Jun. 4, 2008 | (CN) | 2008 1 0067586 |
| Jun. 4, 2008 | (CN) | 2008 1 0067589 |
| Jun. 4, 2008 | (CN) | 2008 1 0067638 |
| Jun. 18, 2008 | (CN) | 2008 1 0067905 |
| Jun. 18, 2008 | (CN) | 2008 1 0067906 |
| Jun. 18, 2008 | (CN) | 2008 1 0067907 |
| Jun. 18, 2008 | (CN) | 2008 1 0067908 |
| Dec. 5, 2008 | (CN) | 2008 1 0218230 |
| Feb. 27, 2009 | (CN) | 2009 1 0105808 |
| Feb. 27, 2009 | (CN) | 2009 1 0105811 |

(51) Int. Cl.
*H04R 25/00* (2006.01)

(52) U.S. Cl. ..... 381/164; 381/386

(58) Field of Classification Search ..... 381/164
See application file for complete search history.

(56) References Cited

U.S. PATENT DOCUMENTS 1,407,726 A * 2/1922 Browne et al. ..... 381/164
1,528,774 A 3/1925 Kranz (Continued)

FOREIGN PATENT DOCUMENTS

CN 2302622 12/1998

(Continued)

OTHER PUBLICATIONS

Chen, Huxiong; Diebold, Gerald, "Chemical Generation of Acoustic Waves: A Giant Photoacoustic Effect", Nov. 10, 1995, Science, vol. 270, pp. 963-966.

(Continued)

*Primary Examiner* — Curtis Kuntz
*Assistant Examiner* — Ryan Robinson
(74) *Attorney, Agent, or Firm* — Altis Law Group, Inc.

(57) ABSTRACT

A thermoacoustic device includes a signal device and a sound wave generator. The sound wave generator includes a base structure and a conductive material located on the base structure. The base structure includes nano-scale elements. The signal device is capable of transmitting an electrical signal to the sound wave generator. The sound wave generator is capable of converting the electrical signal into heat. The heat is capable of being transferred to a medium to cause a thermoacoustic effect.

18 Claims, 16 Drawing Sheets

U.S. PATENT DOCUMENTS

| | | | | |
|---|---|---|---|---|
| 4,002,897 | A | 1/1977 | Kleinman et al. | |
| 4,334,321 | A | 6/1982 | Edelman | |
| 4,503,564 | A | 3/1985 | Edelman et al. | |
| 4,641,377 | A | 2/1987 | Rush et al. | |
| 4,766,607 | A | 8/1988 | Feldman | |
| 5,694,477 | A | 12/1997 | Kole | |
| 6,473,625 | B1 | 10/2002 | Williams et al. | |
| 6,777,637 | B2 | 8/2004 | Nakayama et al. | |
| 6,803,116 | B2 | 10/2004 | Ikeda | |
| 6,803,840 | B2 * | 10/2004 | Hunt et al. | 333/186 |
| 6,808,746 | B1 | 10/2004 | Dai et al. | |
| 6,921,575 | B2 | 7/2005 | Horiuchi et al. | |
| 7,045,108 | B2 | 5/2006 | Jiang et al. | |
| 7,393,428 | B2 | 7/2008 | Huang et al. | |
| 7,474,590 | B2 * | 1/2009 | Watabe et al. | 367/140 |
| 7,723,684 | B1 * | 5/2010 | Haddon et al. | 250/338.1 |
| 7,799,163 | B1 | 9/2010 | Mau et al. | |
| 7,881,157 | B2 * | 2/2011 | Watabe et al. | 367/140 |
| 2001/0005272 | A1 | 6/2001 | Buchholz | |
| 2001/0048256 | A1 | 12/2001 | Miyazaki et al. | |
| 2002/0076070 | A1 | 6/2002 | Yoshikawa et al. | |
| 2003/0038925 | A1 | 2/2003 | Choi | |
| 2003/0165249 | A1 | 9/2003 | Higuchi | |
| 2004/0053780 | A1 | 3/2004 | Jiang et al. | |
| 2005/0040371 | A1 | 2/2005 | Watanabe et al. | |
| 2005/0201575 | A1 * | 9/2005 | Koshida et al. | 381/164 |
| 2006/0072770 | A1 | 4/2006 | Miyazaki | |
| 2006/0094988 | A1 * | 5/2006 | Tosaya et al. | 601/2 |
| 2006/0104451 | A1 | 5/2006 | Browning et al. | |
| 2006/0147081 | A1 | 7/2006 | Mango, III et al. | |
| 2006/0264717 | A1 | 11/2006 | Pesach et al. | |
| 2007/0145335 | A1 | 6/2007 | Anazawa | |
| 2007/0164632 | A1 | 7/2007 | Adachi et al. | |
| 2007/0166223 | A1 | 7/2007 | Jiang et al. | |
| 2007/0176498 | A1 | 8/2007 | Sugiura et al. | |
| 2008/0063860 | A1 | 3/2008 | Song et al. | |
| 2008/0095694 | A1 | 4/2008 | Nakayama et al. | |
| 2008/0170982 | A1 | 7/2008 | Zhang et al. | |
| 2008/0248235 | A1 | 10/2008 | Feng et al. | |
| 2008/0260188 | A1 | 10/2008 | Kim | |
| 2008/0299031 | A1 | 12/2008 | Liu et al. | |
| 2009/0016951 | A1 | 1/2009 | Kawabata et al. | |
| 2009/0028002 | A1 | 1/2009 | Sugiura et al. | |
| 2009/0045005 | A1 | 2/2009 | Byon et al. | |
| 2009/0085461 | A1 | 4/2009 | Feng et al. | |
| 2009/0096346 | A1 | 4/2009 | Liu et al. | |
| 2009/0096348 | A1 | 4/2009 | Liu et al. | |
| 2009/0145686 | A1 | 6/2009 | Watabe et al. | |
| 2009/0153012 | A1 | 6/2009 | Liu et al. | |
| 2009/0167136 | A1 | 7/2009 | Liu et al. | |
| 2009/0167137 | A1 | 7/2009 | Liu et al. | |
| 2009/0196981 | A1 | 8/2009 | Liu et al. | |
| 2009/0232336 | A1 | 9/2009 | Pahl | |
| 2010/0054502 | A1 | 3/2010 | Miyachi | |
| 2010/0054507 | A1 * | 3/2010 | Oh et al. | 381/190 |
| 2010/0086166 | A1 | 4/2010 | Jiang et al. | |
| 2010/0166232 | A1 | 7/2010 | Liu et al. | |
| 2010/0233472 | A1 | 9/2010 | Liu et al. | |
| 2011/0171419 | A1 | 7/2011 | Li et al. | |

FOREIGN PATENT DOCUMENTS

| | | |
|---|---|---|
| CN | 2425468 | 3/2001 |
| CN | 1407392 | 4/2003 |
| CN | 1443021 | 9/2003 |
| CN | 1698400 | 11/2005 |
| CN | 2779422 Y | 5/2006 |
| CN | 1787696 | 6/2006 |
| CN | 2787870 | 6/2006 |
| CN | 2798479 | 7/2006 |
| CN | 1821048 | 8/2006 |
| CN | 1886820 | 12/2006 |
| CN | 1944829 | 4/2007 |
| CN | 1982209 | 6/2007 |
| CN | 1997243 | 7/2007 |
| CN | 101239712 | 8/2008 |
| CN | 101284662 | 10/2008 |
| CN | 201150134 | 11/2008 |
| CN | 101314464 | 12/2008 |
| CN | 101471213 | 7/2009 |
| CN | 101715155 | 5/2010 |
| CN | 101400198 | 9/2010 |
| JP | 49-24593 | 3/1974 |
| JP | 58-9822 | 1/1983 |
| JP | 60-22900 | 2/1985 |
| JP | 1-255398 | 10/1989 |
| JP | 3-147497 | 6/1991 |
| JP | 4-126489 | 4/1992 |
| JP | 7-282961 | 10/1995 |
| JP | 9-105788 | 4/1997 |
| JP | 11-282473 | 10/1999 |
| JP | 11-300274 | 11/1999 |
| JP | 2001333493 | 11/2001 |
| JP | 2002-186097 | 6/2002 |
| JP | 2002-352940 | 12/2002 |
| JP | 2003-154312 | 5/2003 |
| JP | 2003198281 | 7/2003 |
| JP | 2003-266399 | 9/2003 |
| JP | 2003-319490 | 11/2003 |
| JP | 2003-319491 | 11/2003 |
| JP | 2003-332266 | 11/2003 |
| JP | 20042103 | 1/2004 |
| JP | 2004-107196 | 4/2004 |
| JP | 2004229250 | 8/2004 |
| JP | 2005-20315 | 1/2005 |
| JP | 2005-51284 | 2/2005 |
| JP | 2005-73197 | 3/2005 |
| JP | 2005-97046 | 4/2005 |
| JP | 2005189322 | 7/2005 |
| JP | 2005-235672 | 9/2005 |
| JP | 2005-318040 | 11/2005 |
| JP | 2005-534515 | 11/2005 |
| JP | 2005-341554 | 12/2005 |
| JP | 2005333601 | 12/2005 |
| JP | 2006-93932 | 4/2006 |
| JP | 2006-180082 | 7/2006 |
| JP | 2006-202770 | 8/2006 |
| JP | 2006-217059 | 8/2006 |
| JP | 2007-24688 | 2/2007 |
| JP | 2007-54831 | 3/2007 |
| JP | 2007-167118 | 7/2007 |
| JP | 2007-174220 | 7/2007 |
| JP | 2007-187976 | 7/2007 |
| JP | 2007-196195 | 8/2007 |
| JP | 2007-228299 | 9/2007 |
| JP | 2007-527099 | 9/2007 |
| JP | 2008-62644 | 3/2008 |
| JP | 2008-101910 | 5/2008 |
| JP | 2008-163535 | 7/2008 |
| JP | 2008-269914 | 11/2008 |
| JP | 2009-31031 | 2/2009 |
| JP | 2009-91239 | 4/2009 |
| JP | 2009-94074 | 4/2009 |
| JP | 2009-146896 | 7/2009 |
| JP | 2009-146898 | 7/2009 |
| JP | 2009-164125 | 7/2009 |
| JP | 2009-184907 | 8/2009 |
| JP | 2009-184908 | 8/2009 |
| KR | 10-0761548 | 9/2007 |
| TW | 200740976 | 11/2007 |
| TW | 200744399 | 12/2007 |
| TW | 201029481 | 8/2010 |
| WO | WO0073204 | 12/2000 |
| WO | WO2004012932 | 2/2004 |
| WO | WO2005120130 | 12/2005 |
| WO | WO2007043837 | 4/2007 |
| WO | WO2007052928 | 5/2007 |
| WO | WO2007099975 | 9/2007 |
| WO | WO2008/029451 | 3/2008 |

OTHER PUBLICATIONS

Amos, S.W.; "Principles of Transistor Circuits"; 2000; Newnes-Butterworth-Heinemann; 9th ed.;p. 114.

Lee et al., Photosensitization of nonlinear scattering and photoacoustic emission from single-walled carbon nanotubes, Applied Physics Letters, Mar. 13, 2008, 92, 103122.

Alexander Graham Bell, Selenium and the Photophone, Nature, Sep. 23, 1880, pp. 500-503.
Silvanus P. Thompson, The Photophone, Nature, Sep. 23, 1880, vol. XXII, No. 569, pp. 481.
Lin Xiao, Zhuo Chen, Chen Feng, Liang Liu et al., Flexible, Stretchable, Transparent Carbon Nanotube Thin Film Loudspeakers, Nano Letters, 2008, pp. 4539-4545, vol. 8, No. 12, US.
Kai Liu, Yinghui Sun, Lei Chen, Chen Feng, Xiaofeng Feng, Kaili Jiang et al., Controlled Growth of Super-Aligned Carbon Nanotube Arrays for Spinning Continuous Unidirectional Sheets with Tunable Physical Properties, Nano Letters, 2008, pp. 700-705, vol. 8, No. 2.
Braun Ferdinand, Notiz uber Thermophonie, Ann. Der Physik, Apr. 1898, pp. 358-360,vol. 65.
Kaili Jiang, Qunqing Li, Shoushan Fan, Spinning continuous carbon nanotube yarns, Nature, Oct. 24, 2002, pp. 801, vol. 419.
Yang Wei, Kaili Jiang, Xiaofeng Feng, Peng Liu et al., Comparative studies of multiwalled carbon nanotube sheets before and after shrinking, Physical Review B, Jul. 25, 2007, vol. 76, 045423.
Lina Zhang, Chen Feng, Zhuo Chen, Liang Liu et al., Superaligned Carbon Nanotube Grid for High Resolution Transmission Electron Microscopy of Nanomaterials, Nano Letters, 2008, pp. 2564-2569, vol. 8, No. 8.
Strutt John William, Rayleigh Baron, The Theory of Sound, 1926, pp. 226-235, vol. 2.
Swift Gregory W., Thermoacoustic Engines and Refrigerators, Physics Today, Jul. 1995, pp. 22-28, vol. 48.
William Henry Preece, On Some Thermal Effects of Electric Currents, Proceedings of the Royal Society of London, 1879-1880, pp. 408-411, vol. 30.
H.D. Arnold, I.B. Crandall, The Thermophone as a Precision Source of Sound, Physical Review, 1917, pp. 22-38, vol. 10.
W. Yi, L.Lu, Zhang Dianlin et al., Linear Specific Heat of Carbon Nanotubes, Physical Review B, Apr. 1, 1999, vol. 59, No. 14, R9015-9018.
Frank P. Incropera, David P. Dewitt et al., Fundamentals of Heat and Mass Transfer, 6th ed., 2007, pp. A-5, Wiley:Asia.
Zhuangchun Wu, Zhihong Chen, Xu Du et al.,Transparent, Conductive Carbon Nanotube Films, Science, Aug. 27, 2004, pp. 1273-1276, vol. 305.
P. De Lange, on Thermophones, Proceedings of the Royal Society of London. Series A, Apr. 1, 1915, pp. 239-241, vol. 91, No. 628.
Mei Zhang, Shaoli Fang, Anvar A. Zakhidov, Sergey B. Lee et al., Strong, Transparent, Multifunctional, Carbon Nanotube Sheets, Science, Aug. 19, 2005, pp. 1215-1219, vol. 309.
Xiaobo Zhang, Kaili Jiang, Chen Feng, Peng Liu et al., Spinning and Processing Continuous Yarns from 4-Inch Wafer Scale Super-Aligned Carbon Nanotube Arrays, Advanced Materials, 2006, pp. 1505-1510, vol. 18.
Edward C. Wente, The Thermophone, Physical Review, 1922, pp. 333-345,vol. 19.
J.J.Hopfield, Spectra of Hydrogen, Nitrogen and Oxygen in the Extreme Ultraviolet, Physical Review, 1922, pp. 573-588,vol. 20.
Lin Xiao et al., "Flexible, stretchable, transparent carbon nanotube thin film loudspeakers" vol. 8, No. 12, pp. 4539-4545 ,2008.

* cited by examiner

THERMOACOUSTIC DEVICE

BACKGROUND

1. Technical Field

The present disclosure relates to acoustic devices and, particularly, to a thermoacoustic device.

2. Description of Related Art

An acoustic device generally includes a signal device and a sound wave generator. The signal device provides electrical signals to the sound wave generator. The sound wave generator receives the electrical signals and then transforms them into sounds. The sound wave generator is usually a loudspeaker that can emit sound audible to humans.

There are different types of loudspeakers that can be categorized according to their working principles, such as electro-dynamic loudspeakers, electromagnetic loudspeakers, electrostatic loudspeakers and piezoelectric loudspeakers. However, the various types ultimately use mechanical vibration to produce sound waves, in other words they all achieve "electro-mechanical-acoustic" conversion. Among the various types, the electro-dynamic loudspeakers are most widely used. However, the electro-dynamic loudspeakers are dependent on magnetic fields and often weighty magnets. The structures of the electric-dynamic loudspeakers are complicated. The magnet of the electric-dynamic loudspeakers may interfere or even damage other electrical devices near the loudspeakers.

Thermoacoustic effect is a conversion of heat into acoustic signals. The thermoacoustic effect is distinct from the mechanism of the conventional loudspeaker, in which the pressure waves are created by the mechanical movement of the diaphragm. When signals are supplied to a thermoacoustic element, heat is produced in the thermoacoustic element according to the variations of the signal and/or signal strength. The heat propagates into surrounding medium. The heating of the medium causes thermal expansion and produces pressure waves in the surrounding medium, resulting in sound wave generation. Such an acoustic effect induced by temperature waves is commonly called "the thermoacoustic effect".

A thermophone based on the thermoacoustic effect was created by H. D. Arnold and I. B. Crandall (H. D. Arnold and I. B. Crandall, "The thermophone as a precision source of sound", Phys. Rev. 10, pp 22-38 (1917)). They used platinum strip with a thickness of $7\times10^{-5}$ cm as a thermoacoustic element. The heat capacity per unit area of the platinum strip with the thickness of $7\times10^{-5}$ cm is $2\times10^{-4}$ J/cm$^2$·K. However, the thermophone adopting the platinum strip, listened to the open air, sounds extremely weak because the heat capacity per unit area of the platinum strip is too high.

Carbon nanotubes (CNT) are a novel carbonaceous material having extremely small size and extremely large specific surface area. Carbon nanotubes have received a great deal of interest since the early 1990s, and have interesting and potentially useful electrical and mechanical properties, and have been widely used in a plurality of fields. Fan et al. discloses an thermoacoustic device with simpler structure and smaller size, working without the magnet in an article of "Flexible, Stretchable, Transparent Carbon Nanotube Thin Film Loudspeakers", Fan et al., Nano Letters, Vol. 8 (12), 4539-4545 (2008). The thermoacoustic device includes a sound wave generator which is a carbon nanotube film. The carbon nanotube film used in the thermoacoustic device has a large specific surface area, and extremely small heat capacity per unit area that make the sound wave generator emit sound audible to humans. The sound has a wide frequency response range.

Accordingly, the thermoacoustic device adopted the carbon nanotube film has a potential to be actually used instead of the loudspeakers in prior art.

However, the carbon nanotube film used in the thermoacoustic device is constructed by carbon nanotubes joined end-to end by Van der Waals attractive force. The joining points in the carbon nanotube film have relatively large electrical resistance. Thus, to emit sound audible to humans, the thermoacoustic device should work under a relatively large driving voltage.

What is needed, therefore, is to provide a thermoacoustic device having a lower driving voltage.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
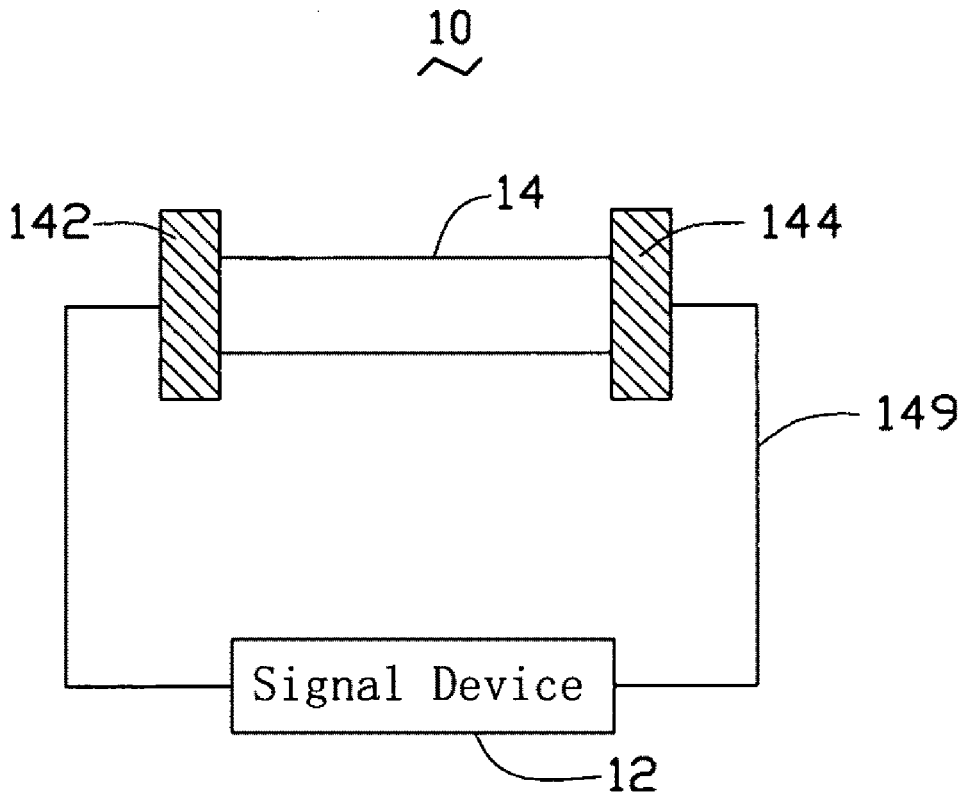
FIG. 1 is a schematic structural view of a thermoacoustic device in accordance with an embodiment.
Figure 2:
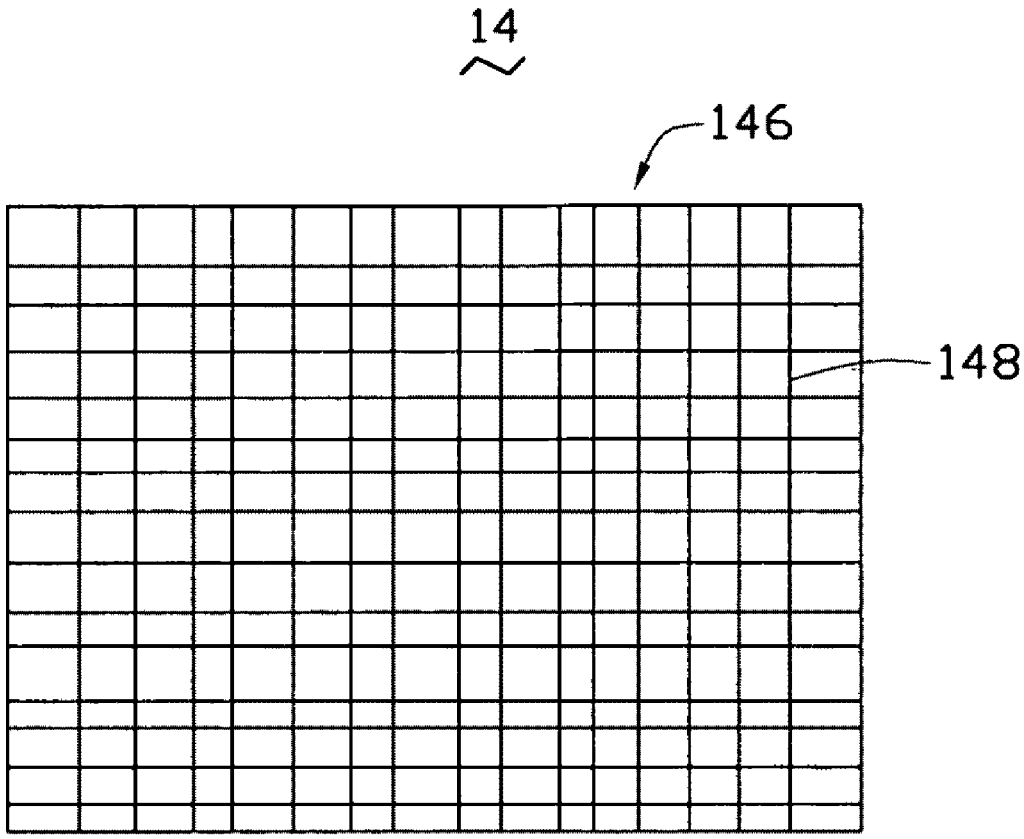
FIG. 2 is a schematic view of a sound wave generator in the thermoacoustic device in FIG. 1.

Referring to FIGS. 1 and 2, a thermoacoustic device 10 according to an embodiment includes a signal device 12, a sound wave generator 14, a first electrode 142, and a second electrode 144. The first electrode 142 and the second electrode 144 are located apart from each other, and are electrically connected to the sound wave generator 14. In addition, the first electrode 142 and the second electrode 144 are electrically connected to the signal device 12. The first electrode 142 and the second electrode 144 input signals from the signal device 12 to the sound wave generator 14.

The sound wave generator 14 includes a base structure 146 and at least a layer of conductive material disposed on the surface of the base structure 146. More specifically, the base structure 146 is a net. The base structure 146 includes a plurality of nano-scale elements 148 contacted to each other. The nano-scale elements 148 can be nanowires, nanotubes, or combinations thereof. In one embodiment, the nano-scale element 148 is a one dimensional material such as the carbon nanotube. The nano-scale element 148 can be conductive or insulative. The nano-scale element 148 can be made of carbon, boron nitride, or silicon. In one embodiment, the nano-scale element 148 includes at least one of carbon nanotube, carbon fiber, boron nitride nanowire, and silicon nanowire. The plurality of nano-scale elements 148 contact each other to form the net, thereby forming the base structure 146 with a relatively large specific surface area. In one embodiment, the base structure 146 has a surface shaped structure and has a relatively small thickness. A surface of the nano-scale element 148 is covered by the at least one layer of conductive material. The conductive material can be metal, alloy, or other material with relatively high conductivity. More specifically, the layer of conductive material covers the individual nano-scale element 148. Due to the plurality of nano-scale elements 148 contacting each other to form the net, the layers of conductive material covered on the surfaces of the nano-scale elements 148 contact each other to form a conducting structure that has a relatively same outer shape as the net formed by the nano-scale elements 148. The conducting structure is connected to the signal device 12.

In one embodiment, the entire surface of each of the nano-scale elements 148 in the base structure 146 is covered by the at least one layer of conductive material. In another embodiment, a part of the surface of the nano-scale elements 148 may be exposed from the layer of conductive material.

The base structure 146 has a relatively large specific surface area and covered by the at least one layer of conductive material, thus, the conducting structure formed by the layer of conductive material on the outside of the base structure 146 has a relatively large specific surface area contacting the surrounding medium, which may be gas or liquid for example. The surrounding medium carries sound emitted from the sound wave generator 14, which may be audible to humans. The at least one layer of conductive material has a relatively small thickness, thus, the sound wave generator 14 has a relatively small heat capacity per unit area.

Carbon Nanotube Structure

The nano-scale elements 148 in the base structure 146 can be the one dimensional material. In one embodiment, the base structure 146 is a carbon nanotube structure. The carbon nanotube structure is the net and constituted by a plurality of carbon nanotubes contacting to each other and substantially uniformly distributed in the carbon nanotube structure.

The carbon nanotubes in the carbon nanotube structure are combined by van der Waals attractive force therebetween to form a free-standing structure. By 'free-standing', it is meant that that the carbon nanotube structure does not have to be supported by a substrate and can sustain the weight of itself when it is hoisted by a portion thereof without tearing.

The carbon nanotube structure can have many different structures and a large specific surface area (e.g., above 50 $m^2/g$). The heat capacity per unit area of the carbon nanotube structure can be less than $2\times10^{-4}$ $J/cm^2*K$. In one embodiment, the heat capacity per unit area of the carbon nanotube structure is less than or equal to about $1.7\times10^{-6}$ $J/cm^2*K$.

The carbon nanotubes in the carbon nanotube structure can be arranged orderly or disorderly. The term 'disordered carbon nanotube structure' includes a structure where the carbon nanotubes are arranged along many different directions, arranged such that the number of carbon nanotubes arranged along each different direction can be almost the same (e.g. uniformly disordered), and/or entangled with each other. The disordered carbon nanotube structure can be isotropic. 'Ordered carbon nanotube structure' includes a structure where the carbon nanotubes are arranged in a systematic manner, e.g., the carbon nanotubes are arranged approximately along a same direction and or have two or more sections within each of which the carbon nanotubes are arranged approximately along a same direction (different sections can have different directions). It is understood that even ordered carbon nanotube structures can have some variations therein.

The carbon nanotubes in the carbon nanotube structure can be selected from a group consisting of single-walled, double-walled, and/or multi-walled carbon nanotubes. It is also understood that there may be many layers of ordered and/or disordered carbon nanotube films in the carbon nanotube structure.

The carbon nanotube structure may have a substantially planar structure. The thickness of the carbon nanotube structure may range from about 0.5 nanometers to about 1 millimeter. The carbon nanotube structure can also be a wire with a diameter ranged from about 0.5 nanometers to about 1 millimeter. The larger the specific surface area of the carbon nanotube structure, the smaller the heat capacity per unit area will be. The smaller the heat capacity per unit area, the higher the sound pressure level of the sound produced by the sound wave generator 14.

The carbon nanotube structure can include at least one carbon nanotube film, at least one carbon nanotube wire, or combinations thereof.

Figure 3:
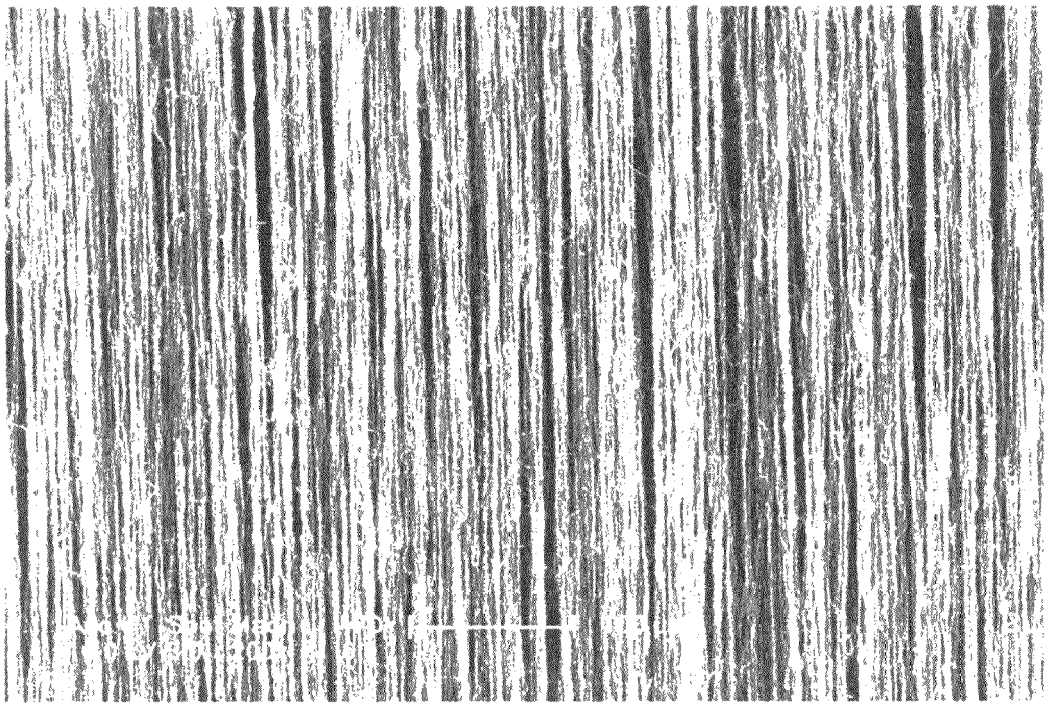
FIG. 3 shows a Scanning Electron. Microscope (SEM) image of a drawn carbon nanotube film.
Figure 4:
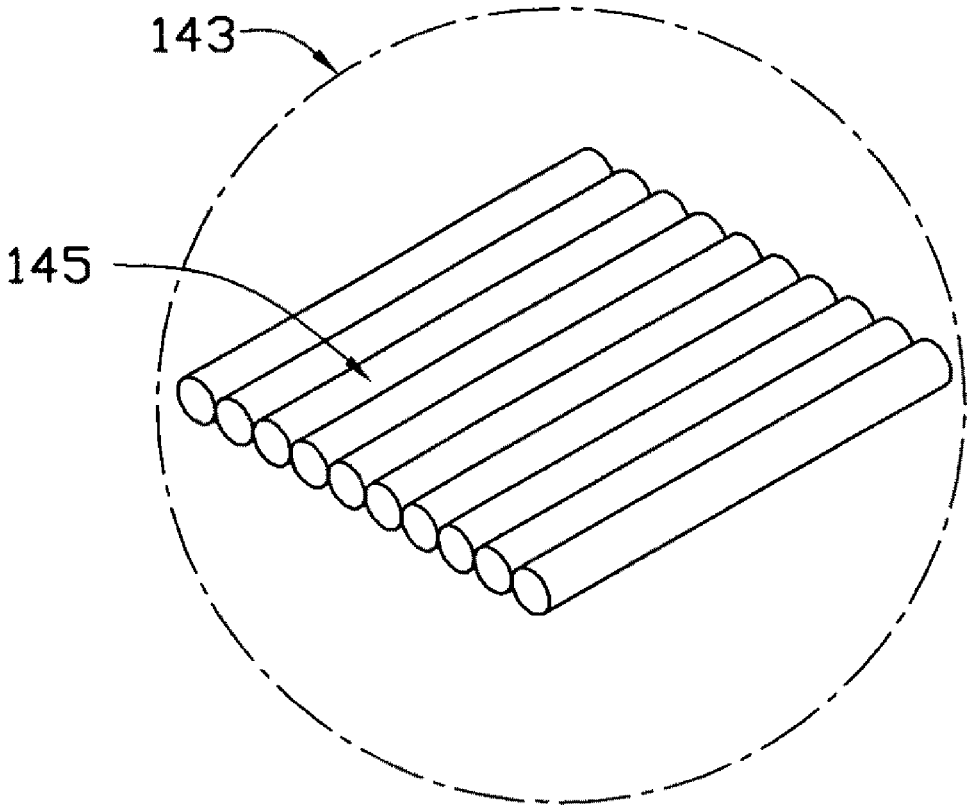
FIG. 4 is a schematic structural view of a carbon nanotube segment.

In one embodiment, the carbon nanotube structure can include at least one drawn carbon nanotube film. The drawn carbon nanotube film includes a plurality of successive and oriented carbon nanotubes joined end-to-end by van der Waals attractive force therebetween. The carbon nanotubes in the carbon nanotube film can be substantially aligned in a single direction. The drawn carbon nanotube film can be a free-standing film. The drawn carbon nanotube film can be formed by drawing a film from a carbon nanotube array that is capable of having a film drawn therefrom. Referring to FIGS. 3 to 4, each drawn carbon nanotube film includes a plurality of successively oriented carbon nanotube segments 143 joined end-to-end by van der Waals attractive force therebetween. Each carbon nanotube segment 143 includes a plurality of carbon nanotubes 145 parallel to each other, and combined by van der Waals attractive force therebetween. As can be seen in FIG. 3, some variations can occur in the drawn carbon nanotube film. The carbon nanotubes 145 in the drawn carbon nanotube film are also oriented along a preferred orientation. The carbon nanotube film also can be treated with a volatile organic solvent. After that, the mechanical strength and toughness of the treated carbon nanotube film are increased and the coefficient of friction of the treated carbon nanotube films is reduced. The treated carbon nanotube film has a larger heat capacity per unit area and thus produces less of a thermoacoustic effect than the same film before treatment. A thickness of the carbon nanotube film can range from about 0.5 nanometers to about 100 micrometers. The thickness of the drawn carbon nanotube film can be very thin and thus, the heat capacity per unit area will also be very low. The single drawn carbon nanotube film has a specific surface area of above about 100 $m^2/g$. In one embodiment, the drawn carbon nanotube film has a specific surface area ranged from 200 $m^2/g$ to 2600 $m^2/g$. The specific surface area of the drawn carbon nanotube film is tested by a Brunauer-Emmet-Teller (BET) method. In one embodiment, the drawn carbon nanotube film has a specific weight of about 0.05 $g/m^2$.

The carbon nanotube structure of the sound wave generator 14 can also include at least two stacked carbon nanotube films. In some embodiments, the carbon nanotube structure can include two or more coplanar carbon nanotube films. These coplanar carbon nanotube films can also be stacked one upon other films. Additionally, an angle can exist between the orientation of carbon nanotubes in adjacent films, stacked and/or coplanar. Adjacent carbon nanotube films can be combined only by the van der Waals attractive force therebetween and without the use of an adhesive. The number of the layers of the carbon nanotube films is not limited. However, as the stacked number of the carbon nanotube films increasing, the specific surface area of the carbon nanotube structure will decrease, and a large enough specific surface area (e.g., above 50 $m^2/g$) must be maintained thereby achieving sufficient sound volume. An angle between the aligned directions of the carbon nanotubes in the two adjacent carbon nanotube films can range from 0° to about 90°. Spaces are defined between two adjacent and side-by-side carbon nanotubes in the drawn carbon nanotube film. When the angle between the aligned directions of the carbon nanotubes in adjacent carbon nanotube films is larger than 0 degrees, a microporous structure is defined by the carbon nanotubes in the sound wave generator 14. The carbon nanotube structure in an embodiment employing these films will have a plurality of micropores. Stacking the carbon nanotube films will add to the structural integrity of the carbon nanotube structure.

Figure 5:
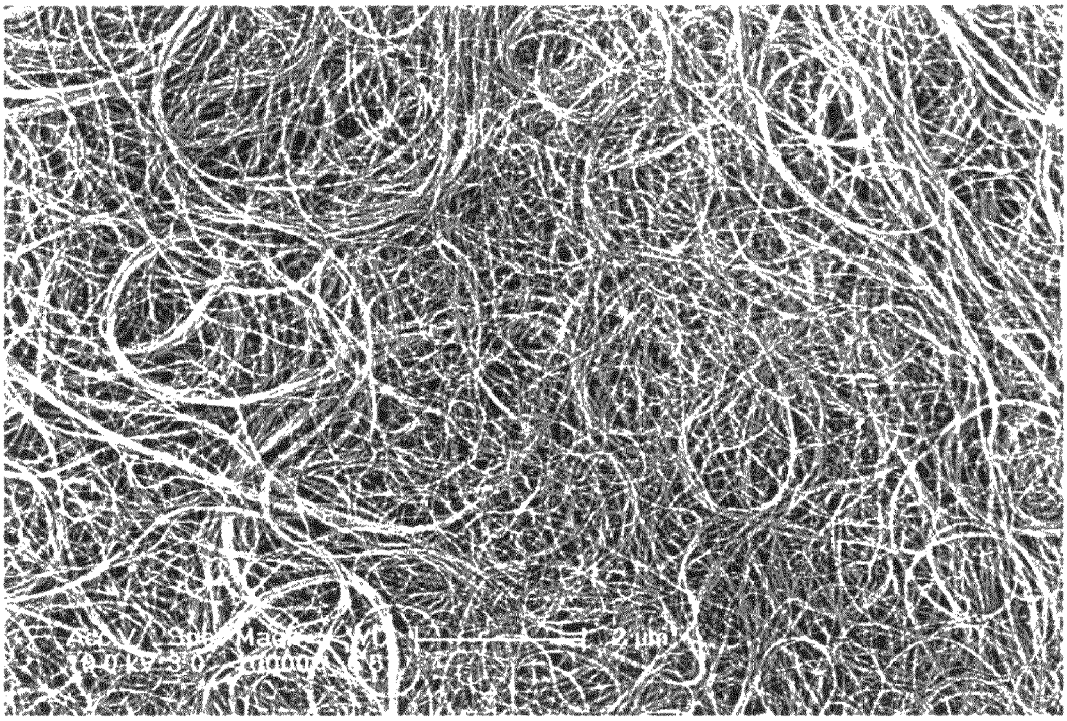
FIG. 5 shows an SEM image of another carbon nanotube film with carbon nanotubes entangled with each other therein.

In other embodiments, the carbon nanotube structure includes a flocculated carbon nanotube film. Referring to FIG. 5, the flocculated carbon nanotube film can include a plurality of long, curved, disordered carbon nanotubes entangled with each other. A length of the carbon nanotubes can be above 10 centimeters. Further, the flocculated carbon nanotube film can be isotropic. The carbon nanotubes can be substantially uniformly dispersed in the carbon nanotube film. The adjacent carbon nanotubes are acted upon by the van der Waals attractive force therebetween, thereby forming an entangled structure with micropores defined therein. It is understood that the flocculated carbon nanotube film is very porous. Sizes of the micropores can be less than 10 micrometers. The porous nature of the flocculated carbon nanotube film will increase specific surface area of the carbon nanotube structure. Further, due to the carbon nanotubes in the carbon nanotube structure being entangled with each other, the carbon nanotube structure employing the flocculated carbon nanotube film has excellent durability, and can be fashioned into desired shapes with a low risk to the integrity of carbon nanotube structure. Thus, the sound wave generator 14 may be formed into many shapes. The flocculated carbon nanotube film, in some embodiments, will not require the use of structural support due to the carbon nanotubes being entangled and adhered together by van der Waals attractive force therebetween. The thickness of the flocculated carbon nanotube film can range from about 0.5 nanometers to about 1 millimeter. It is also understood that many of the embodiments of the carbon nanotube structure are flexible and/or do not require the use of structural support to maintain their structural integrity.

In other embodiments, the carbon nanotube structure includes one or more carbon nanotube wire structures. The carbon nanotube wire structure includes at least one carbon nanotube wire. A heat capacity per unit area of the carbon nanotube wire structure can be less than $2\times10^{-4}$ $J/cm^2*K$. In one embodiment, the heat capacity per unit area of the carbon nanotube wire structure is less than $5\times10^{-5}$ $J/cm^2*K$. The carbon nanotube wire can be twisted or untwisted. The carbon nanotube wire structure includes carbon nanotube cables. Carbon nanotube cable comprises of two or more carbon nanotube wires, twisted or untwisted, that are twisted or bundled together. The carbon nanotube wires in the carbon nanotube wire structure can be parallel to each other to form a bundle-like structure or twisted with each other to form a twisted structure.

Figure 6:
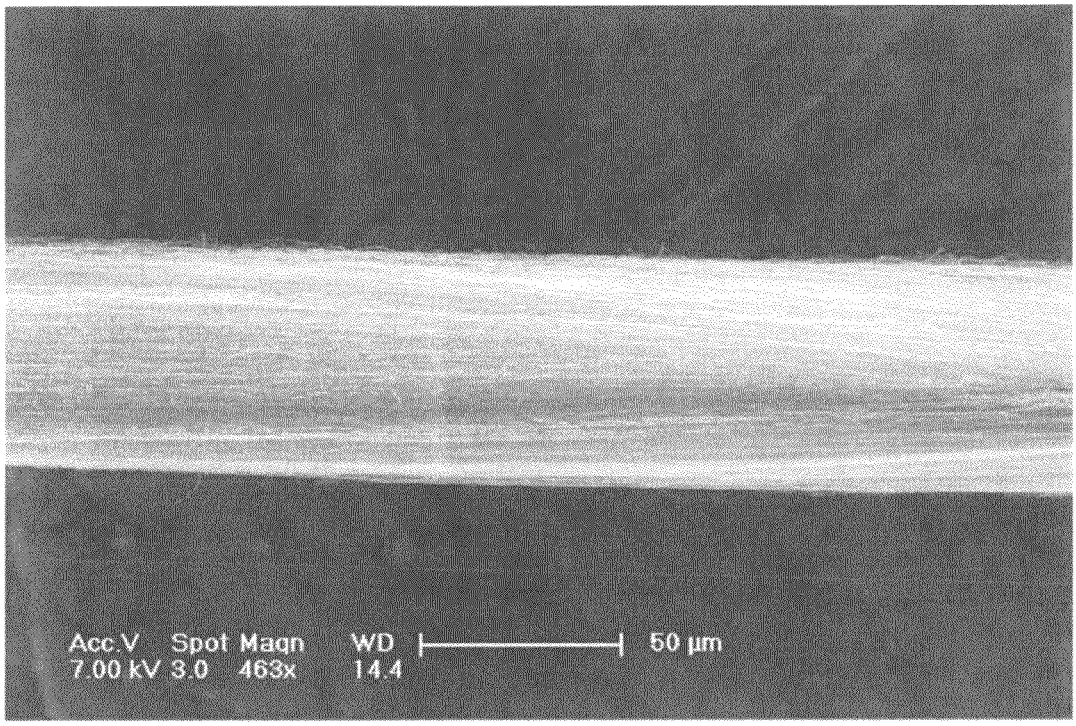
FIG. 6 shows an SEM image of an untwisted carbon nanotube wire.

The untwisted carbon nanotube wire can be formed by treating the drawn carbon nanotube film with an organic solvent. Specifically, the drawn carbon nanotube film is treated by applying the organic solvent to the drawn carbon nanotube film to soak the entire surface of the drawn carbon nanotube film. After being soaked by the organic solvent, the adjacent paralleled carbon nanotubes in the drawn carbon nanotube film will bundle together, due to the surface tension of the organic solvent when the organic solvent volatilizing, and thus, the drawn carbon nanotube film will be shrunk into untwisted carbon nanotube wire. Referring to FIG. 6, the untwisted carbon nanotube wire includes a plurality of carbon nanotubes substantially oriented along a same direction (e.g., a direction along the length of the untwisted carbon nanotube wire). The carbon nanotubes are substantially parallel to the axis of the untwisted carbon nanotube wire. Length of the untwisted carbon nanotube wire can be set as desired. The diameter of an untwisted carbon nanotube wire can range from about 0.5 nanometers to about 100 micrometers. In one embodiment, the diameter of the untwisted carbon nanotube wire is about 50 micrometers. Examples of untwisted carbon nanotube wire are taught by US Patent Application Publication US 2007/0166223 to Jiang et al.

Figure 7:
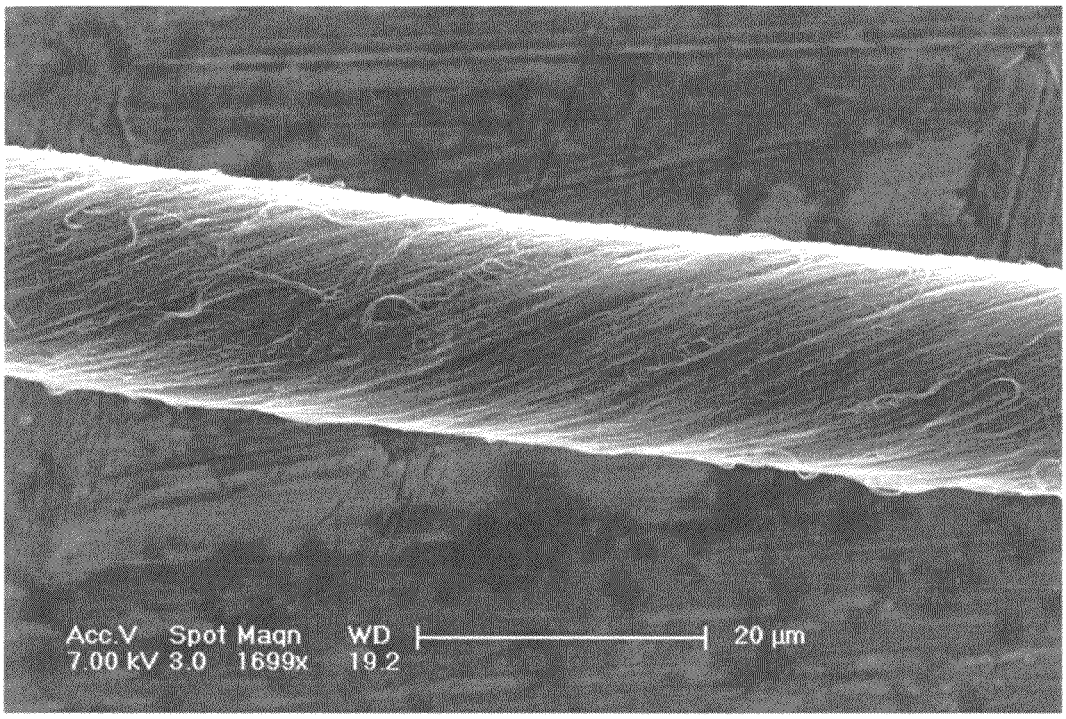
FIG. 7 shows a SEM image of a twisted carbon nanotube wire.

The twisted carbon nanotube wire can be formed by twisting a drawn carbon nanotube film by using a mechanical force to turn the two ends of the drawn carbon nanotube film in opposite directions. Referring to FIG. 7, the twisted carbon nanotube wire includes a plurality of carbon nanotubes oriented around an axial direction of the twisted carbon nanotube wire. The carbon nanotubes are aligned around the axis of the carbon nanotube twisted wire like a helix. Length of the carbon nanotube wire can be set as desired. The diameter of the twisted carbon nanotube wire can range from about 0.5 nanometers to about 100 micrometers. Further, the twisted carbon nanotube wire can be treated with a volatile organic solvent, before or after being twisted. After being soaked by the organic solvent, the adjacent paralleled carbon nanotubes in the twisted carbon nanotube wire will bundle together, due to the surface tension of the organic solvent when the organic solvent volatilizing. The specific surface area of the twisted carbon nanotube wire will decrease. The density and strength of the twisted carbon nanotube wire will be increased because of the treatment. It is understood that the twisted and untwisted carbon nanotube cables can be produced by methods that are similar to the methods of making twisted and untwisted carbon nanotube wires.

Figure 8:
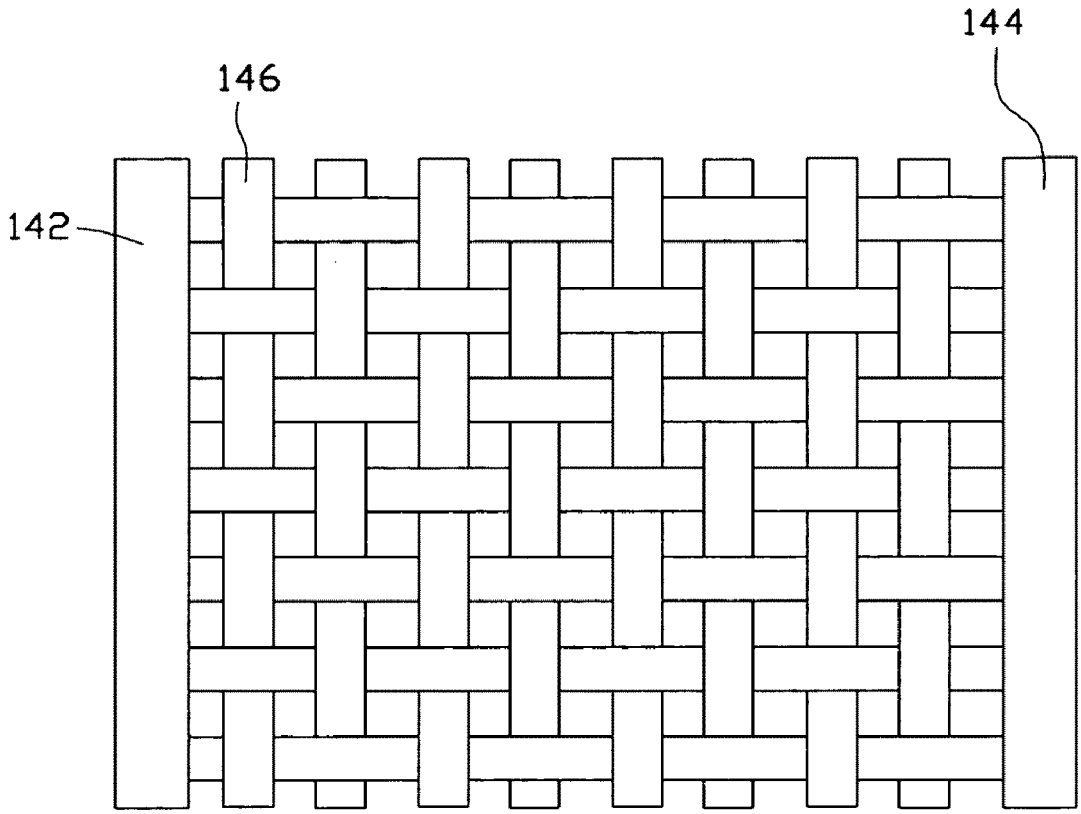
FIG. 8 shows schematic of a textile formed by a plurality of carbon nanotube wires and/or films.

The carbon nanotube structure can include a plurality of carbon nanotube wire structures. The plurality of carbon nanotube wire structures can be paralleled with each other, cross with each other, weaved together, or twisted with each other. The resulting structure can be a planar structure if so desired. Referring to FIG. 8, a carbon nanotube textile can be formed by the carbon nanotube wire structures 146 and used as the carbon nanotube structure. The first electrode 142 and the second electrode 144 can be located at two opposite ends of the textile and electrically connected to the carbon nanotube wire structures 146. It is also understood that the carbon nanotube textile can also be formed by treated and/or untreated carbon nanotube films.

Figure 9:
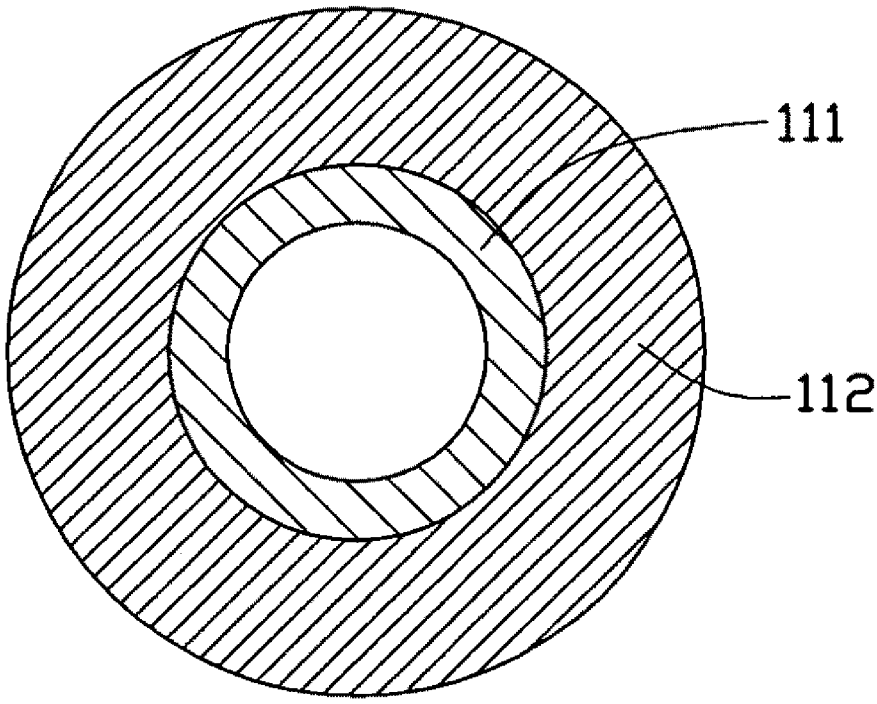
FIG. 9 is a schematic view of a carbon nanotube with at least one layer of conductive material thereon.

The surface of the nano-scale elements 148 in the base structure 146 can be coated by the at least one layer of conductive material. Referring to FIG. 9, the sound wave generator 14 can be a carbon nanotube composite structure including the above-described carbon nanotube structure, wherein the carbon nanotube structure is used as the base structure 146, the carbon nanotubes 111 in the carbon nanotube structure are used as the nano-scale elements 148, and at least one layer of conductive material 112 is disposed on the outer surface of the carbon nanotubes 111. In one embodiment, the entire outer surface of each of the carbon nanotubes 111 is covered by the at least one layer of conductive material 112.

In one embodiment, the carbon nanotube structure is a drawn carbon nanotube film, the outer surface of the carbon nanotubes 111 in the drawn carbon nanotube film can be covered by the at least one layer of conductive material 112 to form the carbon nanotube composite film used as the sound wave generator.

The Layer of Conductive Material

Figure 10:
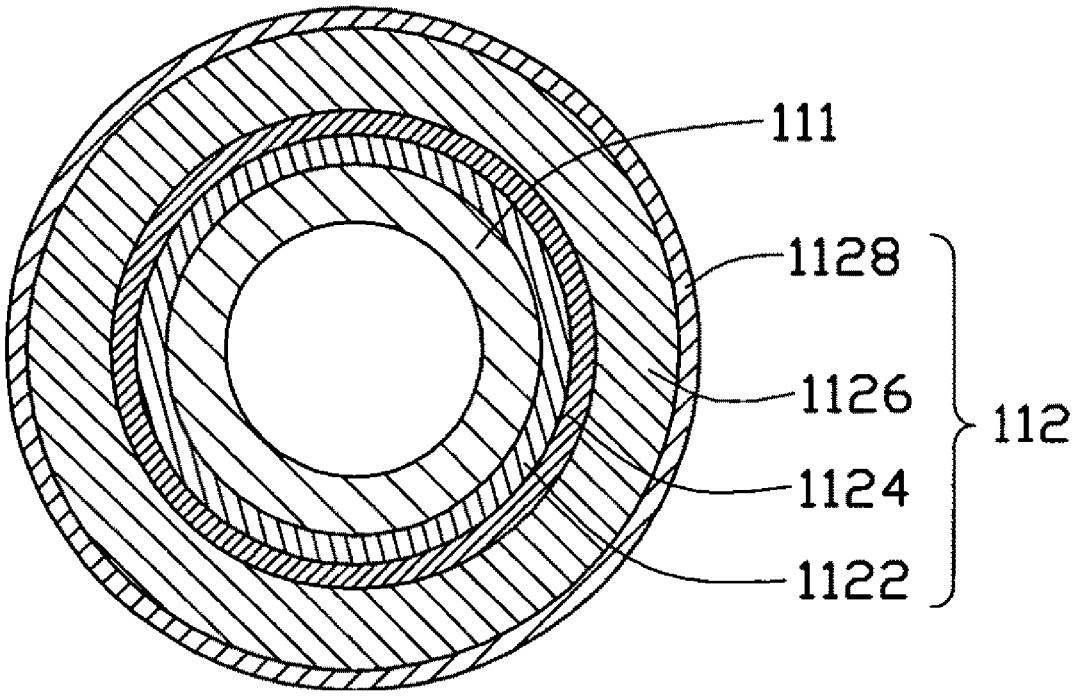
FIG. 10 is a schematic view of a carbon nanotube with four layers of conductive material thereon.

The material of the at least one layer of conductive material 112 can comprise of iron (Fe), cobalt (Co), nickel (Ni), palladium (Pd), titanium (Ti), copper (Cu), silver (Ag), gold (Au), platinum (Pt), and combinations thereof. The thickness of the layer of conductive material 112 can be ranged from about 1 nanometer to about 100 nanometers. In one embodiment, the thickness of the layer of conductive material 112 can be less than about 20 nanometers. More specifically, referring to FIG. 10, the at least one layer of conductive material 112 can, from inside to outside, include a wetting layer 1122, a transition layer 1124, a conductive layer 1126, and an anti-oxidation layer 1128. The wetting layer 1122 is the innermost layer and contactingly covers the surface of the carbon nanotube 111. The transition layer 1124 enwraps the wetting layer. The conductive layer 1126 enwraps the transition layer 1124. The anti-oxidation layer 1128 enwraps the conductive layer 1126. The wetting layer 1122 wets the carbon nanotubes 111. The transition layer 1124 wets both the wetting layer 1122 and the conductive layer 1126, thus combining the wetting layer 1122 with the conductive layer 1126. The conductive layer 1126 has high conductivity. The anti-oxidation layer 1128 is anti oxidation to prevent the conductive layer 1126 from being oxidized by exposure to the air and prevent reduction of the conductivity of the carbon nanotube composite film.

In one embodiment, the at least one layer of conductive material 112 comprises a Ni layer located on the outer surface of the carbon nanotube 111 and is used as the wetting layer 1122. An Au layer is located on the Ni layer and used as the conductive layer 1126. The thickness of the Ni layer is about 2 nanometers. The thickness of the Au layer is about 15 nanometers.

The at least one layer of conductive material 112 can be placed on the carbon nanotubes 111 in a carbon nanotube structure by use of a physical vapor deposition (PVD) method such as vacuum evaporation or spattering, a chemical vapor deposition (CVD) method, and a plating method such as a electroplating or a electroless plating.

The at least one layer of the conductive material 112 can be deposited on the surface of the carbon nanotubes 111 in the above-described carbon nanotube film in a vacuum chamber by using a sputter method. When the carbon nanotube structure used as the base structure 146 includes several stacked carbon nanotube films, the carbon nanotube composite films can be individually formed before stacking the carbon nanotube composite films with each other. When the carbon nanotube structure used as the base structure 146 includes at least one carbon nanotube twisted wire, the carbon nanotube composite film can be individually formed before twisting the carbon nanotube composite film, thereby forming the carbon nanotube twisted wire wherein the carbon nanotubes 111 are covered by the layer of conductive material 112.

Sound Wave Generator with a Single Drawn Carbon Nanotube Film

Figure 11:
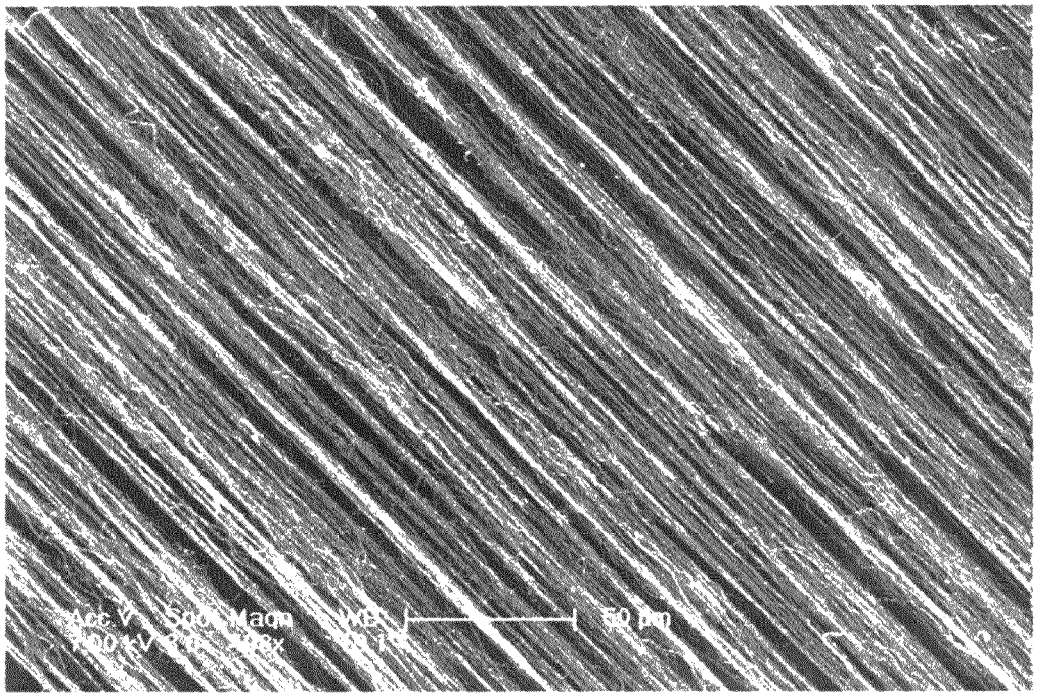
FIG. 11 shows an SEM image of a carbon nanotube composite film.
Figure 12:
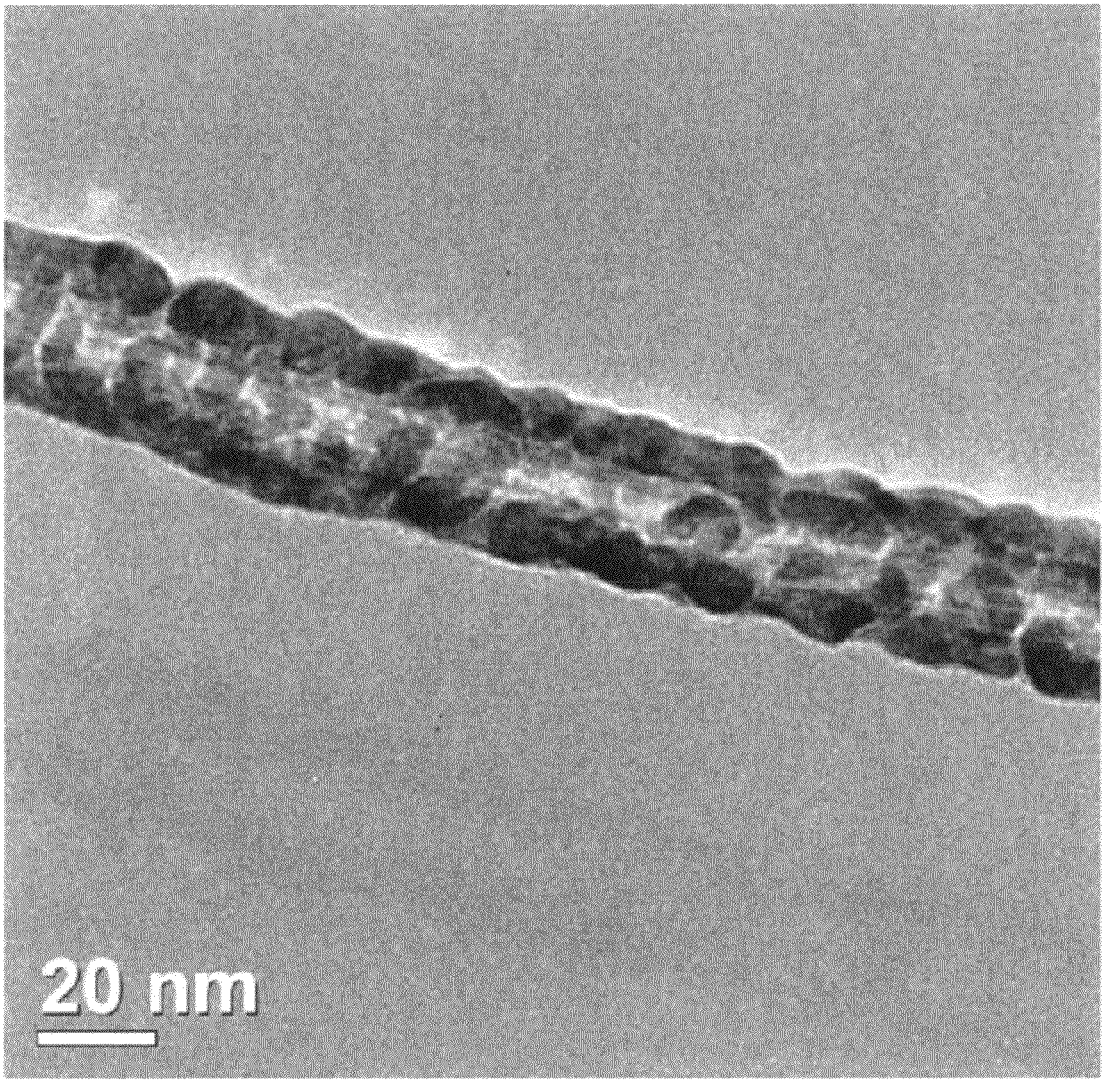
FIG. 12 shows a Transmission Electron Microscope (TEM) image of a carbon nanotube composite.

In one embodiment, the sound wave generator 14 comprises of a single drawn carbon nanoutube film. A microscopic view of the carbon nanotube composite film used as the sound wave generator 14 formed from a single drawn carbon nanotube film with layers of conductive material thereon in is shown in FIGS. 11 and 12. A method for forming the carbon nanotube composite film is taught by U.S. patent application Ser. No. 12/321,557 to Liu et al. Due to the small thickness of the at least one layer of conductive material 112, the sound wave generator 14 has a relatively small heat capacity per unit area. For the reason that the drawn carbon nanotube film has a relatively large specific surface area, and the at least one layer of conductive material 112 is directly covered on the surface of each carbon nanotube 111 in the drawn carbon nanotube film, the sound wave generator 14 has a relatively large specific surface area.

Optionally, to increase the transparency of the sound wave generator 14, before covering the at least one layer of conductive material 112 on the surfaces of the carbon nanotubes 111, the drawn carbon nanotube film can be treated by a laser to decrease the thickness of the drawn carbon nanotube film. The surface of the drawn carbon nanotube film is irradiated by the laser. In one embodiment, the laser uses infrared light, the frequency of the laser is 1064 nanometers, the output power of the laser is about 20 mW, and the scanning rate of the laser is about 10 mm/s. To avoid damage to the drawn carbon nanotube film from the laser, the focus lens of the laser device used to emit the laser is removed. A diameter of a bright spot formed by the laser beam on the surface of the drawn carbon nanotube film is about 3 millimeters. The heat capacity per unit area of the drawn carbon nanotube film and/or the carbon nanotube structure will increase after the laser treatment.

A sound wave generator 14 formed from laser treated and untreated drawn carbon nanotube films with different layers of conductive materials, and the pure drawn carbon nanotube film, having different square resistances and transmittances of a visible light with a frequency of 550 nanometers are compared in the table 1.

TABLE 1

| No. | Treated or untreated with laser | Wetting layer/ Thickness | Conductive layer/ Thickness | Ohms per square (Ω) | Transmittance (%) |
|---|---|---|---|---|---|
| 1 | untreated | — | — | 1684 | 85.2 |
| 2 | untreated | Ni/2 nm | — | 1656 | 79.0 |
| 3 | untreated | Ni/2 nm | Au/3 nm | 504 | 74.6 |
| 5 | untreated | Ni/2 nm | Au/5 nm | 216 | 72.5 |
| 6 | treated | Ni/2 nm | Au/5 nm | 2127 | 92.8 |
| 7 | treated | Ni/2 nm | Au/10 nm | 1173 | 92.7 |
| 8 | treated | Ni/2 nm | Au/15 nm | 495 | 90.7 |
| 9 | treated | Ni/2 nm | Au/20 nm | 208 | 89.7 |

As shown in table 1, due to the at least one layer of the conductive material 112 being applied to the outside of the carbon nanotubes 111, the resistance of the sound wave generator 14 is lower than the pure drawn carbon nanotube film.

However, the transmittance and transparency of the sound wave generator 14 is decreased as the thickness of the layer of conductive material 112 increases. This disadvantage can be mitigated by treating the carbon nanotube film with the laser. After being treated with laser, the transmittance and transparency of the sound wave generator 14 is increased. A conclusion drawn after many tests, is that the resistance of a sound wave generator 14 can be decreased to the range from about 50Ω to about 2000Ω, the transmittance of visible light can be increased to the range from about 70% to about 95%.

In one embodiment, the resistance of the carbon nanotube film without the layer of conductive material is above 1600 ohms. After depositing a Ni layer and an Au layer, the resistance of the sound wave generator 14 reduces to about 200 ohms. The transmittance of visible light is approximately 90%. Thus, the sound wave generator 14 in the present embodiment has a low resistance and a high transparency.

The at least one layer of conductive material 112 covered on the surface of the carbon nanotubes 111 in the drawn carbon nanotube film makes the sound wave generator 14 have a relatively high conductivity and relatively small sheet resistance compared with the pure carbon nanotube film, thereby reducing the level of driving voltage of the sound wave generator 14 needed to emit audible sound.

The carbon nanotube structure can have a relatively large specific surface area and a relatively small heat capacity per unit area. Thus, when an electrical signal is conducted into the sound wave generator 14, the temperature of the sound wave generator 14 is changed quickly, and thermal exchange between the sound wave generator 14 and the surrounding medium is quick. The thermal wave produced by the sound wave generator 14 induces the expansion and contraction of the surrounding medium, and thereby produces sound. The surrounding medium can be gas or liquid. In one embodiment, the maximum power density for driving the sound wave generator 14 is about $5\times10^4$ W/m$^2$.

It is to be understood that, the layer of conductive material 112 can be very thin and cover the individual nano-scale elements 148 in the base structure 146, and the base structure 146 has a large specific surface area, and thus, the conducting structure formed by the layer of conductive material 112 also has a large specific surface area that contacting with the surrounding medium. Therefore, the conducting structure can work according to the "electrical-thermal-sound" principle. When the base structure 156 is conductive (e.g., carbon nanotube structure), the base structure 156 and the layer of conductive material 112 can also transform electric energy into heat. There is a thermal conduction from the base structure 156 to the layer of conductive material 112, so any heat produced in the base structure 156 can be transferred to the layer of conductive material 112.

It is to be understood that, besides the carbon nanotubes 111, the nano-scale element 148 in the base structure 146 can also be other conductive or non-conductive nano-scale material. For example, the base structure 146 can be a carbon fiber structure including a plurality of carbon fibers, a boron nitride nanowire structure including a plurality of boron nitride nanowires, of a silicon nanowire structure including a plurality of silicon nanowires. The base structure 146 can be a free-standing structure. In one embodiment, the free-standing boron nitride nanowire film can be formed by a liquid infiltrating method. The nano-scale elements 148 contact with each other, and thus, the layer of conductive material 112 formed thereon contact with each other to form the conducting structure.

In general, to produce enough volume of sound, the base structure 146 and the conducting structure formed by the layer of conductive material 112 on the base structure 146 should have a relatively large specific surface area (e.g., above 50 m$^2$/g); the sound wave generator 14 as a whole should have a relatively small heat capacity per unit area (e.g., below $2\times10^{-4}$ J/cm$^2$·K). To comply with the first need, the thickness of the layer of conductive material can be very small. To comply with the second need, the base structure 146 can be free-standing, and have a small heat capacity and large specific surface area.

Electrodes

The first electrode 142 and the second electrode 144 are configured for electrically connecting the signal device 12 to the sound wave generator 14. When the base structure 146 is insulative, the first electrode 142 and the second electrode 144 are connected to the layer of conductive material 112. When the base structure 146 is conductive, the first electrode 142 and the second electrode 144 can be connected to the layer of conductive material 112, or the base structure 146.

The first electrode 142 and the second electrode 144 are made of conductive material. The shape of the first electrode 142 or the second electrode 144 is not limited and can be lamellar, rod, wire, and block among other shapes. A material of the first electrode 142 or the second electrode 144 can be metals, conductive adhesives, carbon nanotubes, and indium tin oxides among other materials. In one embodiment, the first electrode 142 and the second electrode 144 are rod-shaped metal electrodes. The sound wave generator 14 is electrically connected to the first electrode 142 and the second electrode 144. The electrodes can provide structural support for the sound wave generator 14. The first electrode 142 and the second electrode 144 can be electrically connected to two terminals of the signal device 12 by a conductive wire 149.

In other embodiments, a conductive adhesive layer (not shown) can be further provided between the first electrode 142 or the second electrode 144 and the sound wave generator 14. The conductive adhesive layer can be applied to the surface of the sound wave generator 14. The conductive adhesive layer can be used to provide electrical contact and more adhesion between the electrodes 142 or 144 and the sound wave generator 14. In one embodiment, the conductive adhesive layer is a layer of silver paste.

The first and second electrodes 142, 144 are separately connected with the sound wave generator 14 thereby the electrical signals can be conducted through the sound wave generator 14. In one embodiment, when the base structure 146 is a carbon nanotube structure, the carbon nanotubes 111 in the carbon nanotube structure are aligned along a direction from the first electrode 142 to the second electrode 144. More specifically, when the carbon nanotube structure includes at least one drawn carbon nanotube film, the drawn carbon nanotube film is aligned along the direction from the first electrode 142 to the second electrode 144. The carbon nanotubes in the drawn carbon nanotube film joined end-to-end thereby connecting the first electrode 142 with the second electrode 144.

In one embodiment, the first electrode 142 is parallel to the second electrode 144. More specifically, the carbon nanotubes in the carbon nanotube structure can be aligned along the direction perpendicular to the first and second electrodes 142, 144. The length of the first and second electrodes 142, 144 can be equal to or larger than the width of the sound wave generator 14 thereby introducing the electrical signal into the entire sound wave generator 14, and optimizing the utilization of the sound wave generator 14.

The signal device 12 can include the electrical signal devices, pulsating direct current signal devices, and/or alternating current devices. The electrical signals input from the signal device 12 to the sound wave generator 14 can be, for example, alternating electrical current, pulsating direct current signals, signal devices and/or audio electrical signals or a combination thereof. Energy of the electrical signals is absorbed by the sound wave generator 14 and then radiated as heat. This heating causes detectable sound signals due to pressure variation in the surrounding (environmental) medium.

It also can be understood that the first electrode 142 and the second electrode 144 are optional. The electrical signal can be directly conducted to the sound wave generator 14 from the signal device 12 through electrical conductive wires 148 connected between the sound wave generator 14 and the signal device 12.

The sound wave generator 14 has a small heat capacity per unit area, and a large surface area for causing the pressure oscillation in the surrounding medium by the temperature waves generated by the sound wave generator 14. In use, when electrical signals, with variations in the application of the electrical signal and/or strength are input applied to the sound wave generator 14, heating is produced in the sound wave generator 14 according to the variations of the signal and/or signal strength. Temperature waves, which are propagated into surrounding medium, are obtained. The temperature waves produce pressure waves in the surrounding medium, resulting in sound generation. In this process, it is the thermal expansion and contraction of the medium in the vicinity of the sound wave generator 14 that produces sound. This is distinct from the mechanism of the conventional loudspeaker, in which the pressure waves are created by the mechanical movement of the diaphragm. The operating principle of the thermoacoustic device 10 is an "electrical-thermal-sound" conversion.

In one embodiment, an alternating electrical signal with 50 volts is applied to the sound wave generator 14. A microphone put about 5 centimeters away from the in front of the sound wave generator 14 is used to measure the performance of the thermoacoustic device 10. The thermoacoustic device 10 has a wide frequency response range and a high sound pressure level. The sound pressure level of the sound waves generated by the thermoacoustic device 10 can be greater than 50 dB. The sound pressure level generated by the thermoacoustic device 10 reaches up to 100 dB. The frequency response range of the thermoacoustic device 10 can be from about 100 Hz to about 100 KHz with power input of 4.5 W.

Further, when the carbon nanotube structure is used as the base structure 146, since the carbon nanotube structure has an excellent mechanical strength and toughness, the carbon nanotube structure can be tailored to any desirable shape and size, allowing a thermoacoustic device 10 of most any desired shape and size to be achieved. The thermoacoustic device 10 can be applied to a variety of other acoustic devices, such as sound systems, mobile phones, MP3s, MP4s, TVs, computers, and so on. It can also be applied to flexible articles such as clothing and flags.

Figure 13:
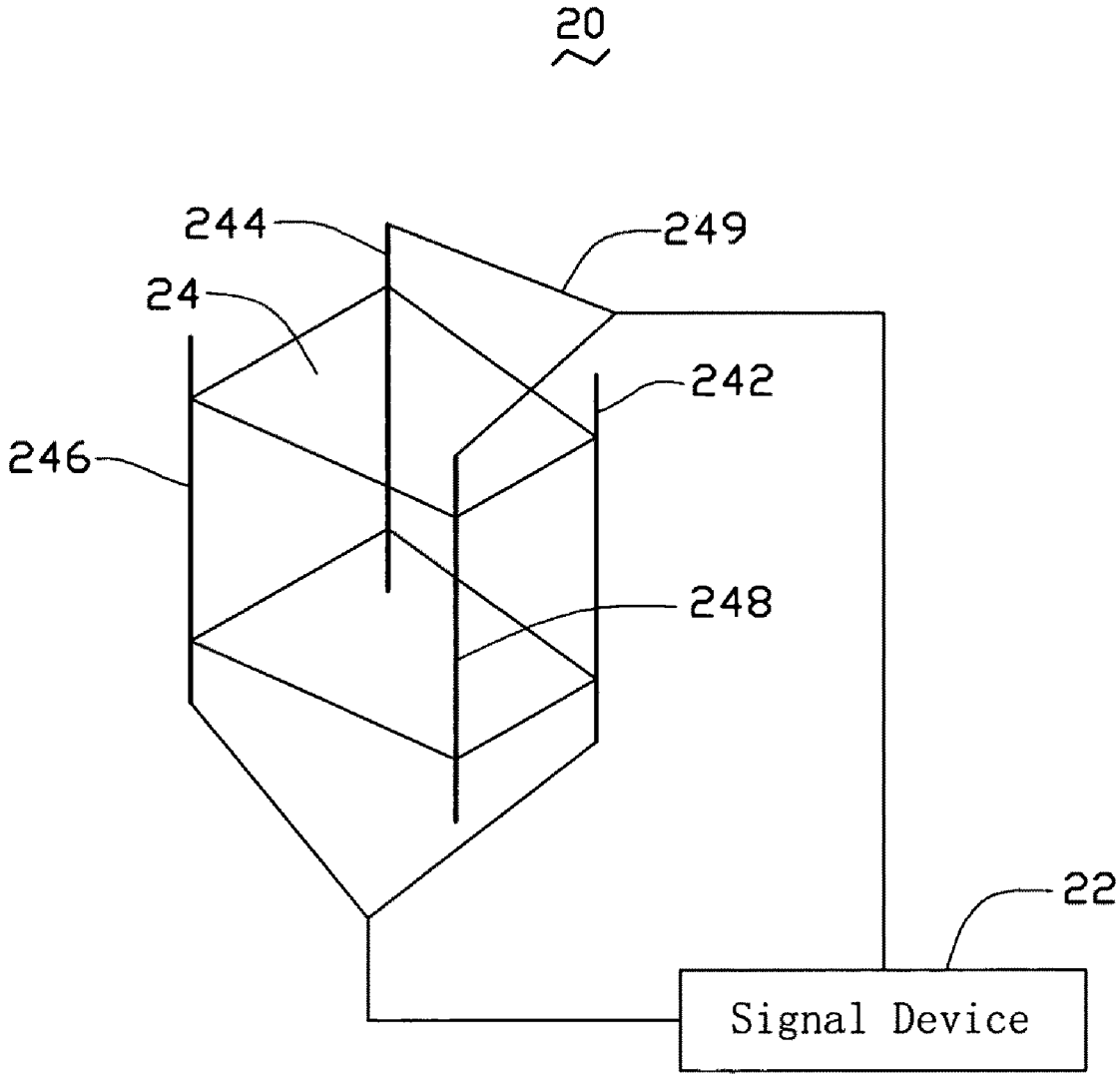
FIG. 13 is a schematic structural view of a thermoacoustic device in accordance with an embodiment.

Referring to FIG. 13, a thermoacoustic device 20, according to an embodiment, includes a signal device 22, a sound wave generator 24, a first electrode 242, a second electrode 244, a third electrode 246, and a fourth electrode 248.

The compositions, features and functions of the thermoacoustic device 20 in the embodiment shown in FIG. 13 are similar to the thermoacoustic device 10 in the embodiment shown in FIG. 1. The difference is that, the present thermoacoustic device 20 includes four electrodes, the first electrode 242, the second electrode 244, the third electrode 246, and the fourth electrode 248. The first electrode 242, the second electrode 244, the third electrode 246, and the fourth electrode 248 are all rod-like metal electrodes, located apart from and parallel to each other. The first electrode 242, the second electrode 244, the third electrode 246, and the fourth electrode 248 form a three dimensional structure. The sound wave generator 24 surrounds the first electrode 242, the second electrode 244, the third electrode 246, and the fourth electrode 248. The sound wave generator 24 is electrically connected to the first electrode 242, the second electrode 244, the third electrode 246, and the fourth electrode 248. As shown in the FIG. 13, the first electrode 242 and the third electrode 246 are electrically connected in parallel to one terminal of the signal device 22 by a first conductive wire 249. The second electrode 244 and the fourth electrode 248 are electrically connected in parallel to the other terminal of the signal device 22 by a second conductive wire 249'. The parallel connections in the sound wave generator 24 provide for lower resistance, thus input voltage required to the thermoacoustic device 20, can be lowered. The sound wave generator 24, according to the present embodiment, can radiate thermal energy out to surrounding medium, and thus create sound. It is understood that the first electrode 242, the second electrode 244, the third electrode 246, and the fourth electrode 248 also can be configured to and serve as a support for the sound wave generator 24.

It is to be understood that the first electrode 242, the second electrode 244, the third electrode 246, and the fourth electrode 248 also can be coplanar. Further, a plurality of electrodes, such as more than four electrodes, can be employed in the thermoacoustic device 20 according to needs following the same pattern of parallel connections as when four electrodes are employed.

Figure 14:
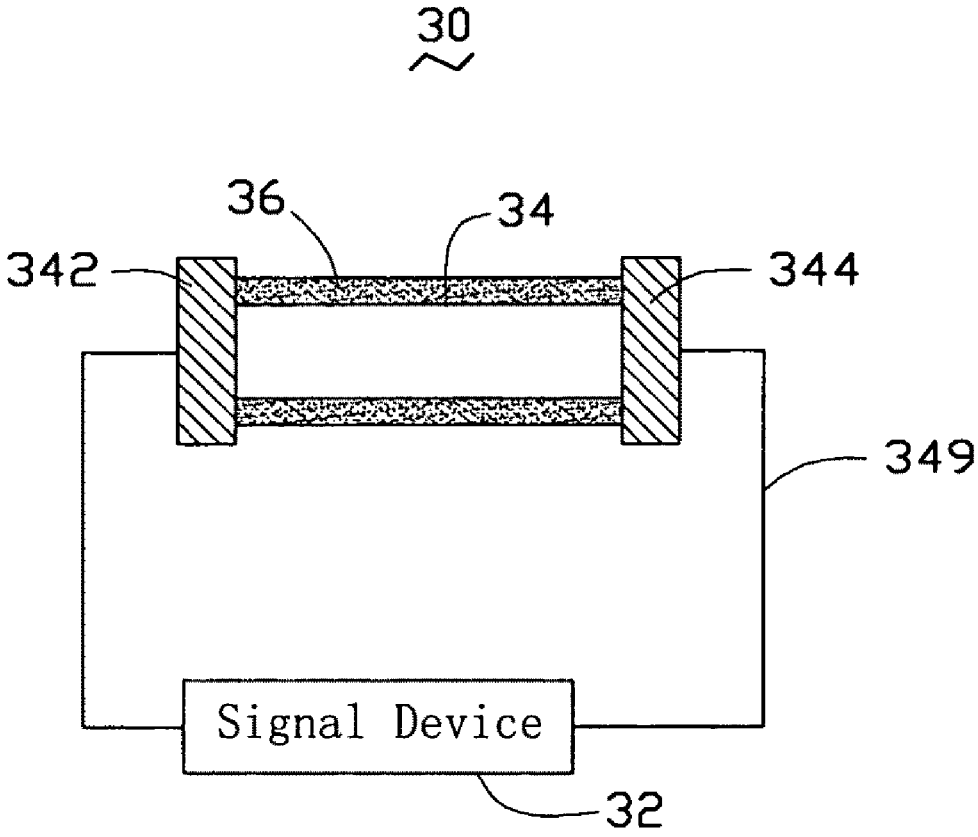
FIG. 14 is a schematic structural view of a thermoacoustic device in accordance with an embodiment.

Referring to FIG. 14, a thermoacoustic device 30 according to an embodiment includes a signal device 32, a sound wave generator 34, a supporting element 36, a first electrode 342, and a second electrode 344.

The compositions, features and functions of the thermoacoustic device 30 in the embodiment shown in FIG. 14 are similar to the thermoacoustic device 10 in the embodiment shown in FIG. 1. The difference is that the present thermoacoustic device 30 includes the supporting element 36, and the sound wave generator 34 is located on a surface of the supporting element 36.

The supporting element 36 is configured for supporting the sound wave generator 34. A shape of the supporting element 36 is not limited, nor is the shape of the sound wave generator 34. The supporting element 36 can have a planar and/or a curved surface. The supporting element 36 can also have a surface where the sound wave generator 34 is can be securely located, exposed or hidden. The supporting element 36 may be, for example, a wall, a desk, a screen, a fabric or a display (electronic or not). The sound wave generator 34 can be located directly on and in contact with the surface of the supporting element 36.

The material of the supporting element 36 is not limited, and can be a rigid material, such as diamond, glass or quartz, or a flexible material, such as plastic, resin or fabric. The supporting element 36 can have a good thermal insulating property, thereby preventing the supporting element 36 from absorbing the heat generated by the sound wave generator 34. In addition, the supporting element 36 can have a relatively rough surface, thereby the sound wave generator 34 can have an increased contact area with the surrounding medium.

Electrodes can be connected on any surface of the sound wave generator 34. The first electrode 342 and the second electrode 344 can be on the same surface of the sound wave generator 34 or on two different surfaces of the sound wave generator 34. It is understood that more than two electrodes can be on surface(s) of the sound wave generator 34, and be connected in the manner described above.

The signal device 32 can be connected to the sound wave generator 34 directly via a conductive wire. Anyway that can electrically connect the signal device 32 to the sound wave generator 34 and thereby input signal to the sound wave generator 34 can be adopted.

Figure 15:
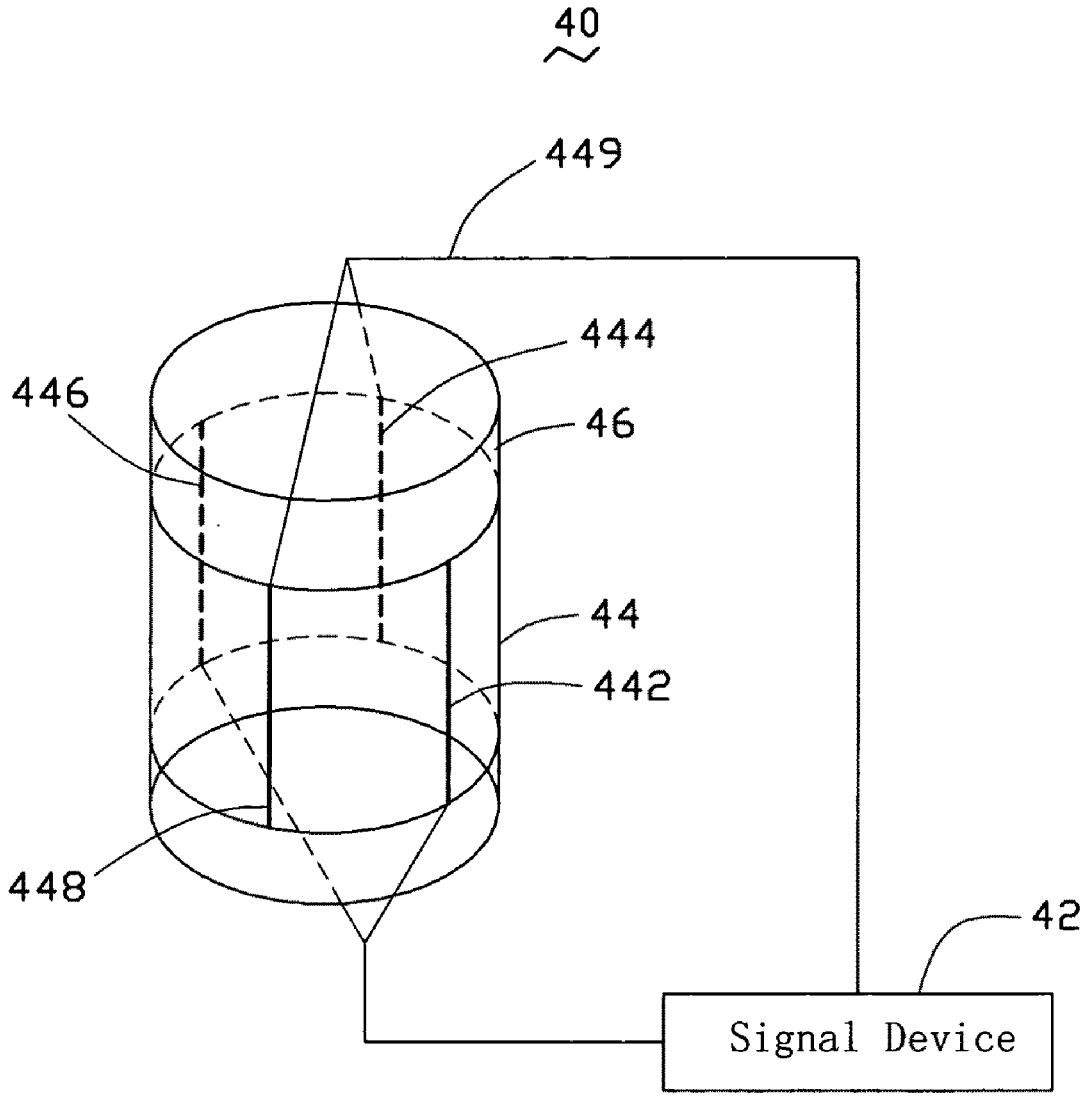
FIG. 15 is a schematic structural view of a thermoacoustic device in accordance with another embodiment.

Referring to FIG. 15, an thermoacoustic device 40 according to an embodiment includes a signal device 42, a sound wave generator 44, a supporting element 46, a first electrode 442, a second electrode 444, a third electrode 446, and a fourth electrode 448.

The compositions, features and functions of the thermoacoustic device 40 in the embodiment shown in FIG. 15 are similar to the thermoacoustic device 30 in the embodiment shown in FIG. 14. The difference is that the sound wave generator 44 as shown in FIG. 15 surrounds the supporting element 46. A shape of the supporting element 46 is not limited, and can be most any three or two dimensional structure, such as a cube, a cone, or a cylinder. In one embodiment, the supporting element 46 is cylinder-shaped. The first electrode 442, the second electrode 444, the third electrode 446, and the fourth electrode 448 are separately located on a surface of the sound wave generator 44 and electrically connected to the sound wave generator 44. Connections between the first electrode 442, the second electrode 444, the third electrode 446, the fourth electrode 448 and the signal device 42 can be the same as described in the embodiment as shown in FIG. 14. It can be understood that a number of electrodes other than four can be in contact with the sound wave generator 44.

Figure 16:
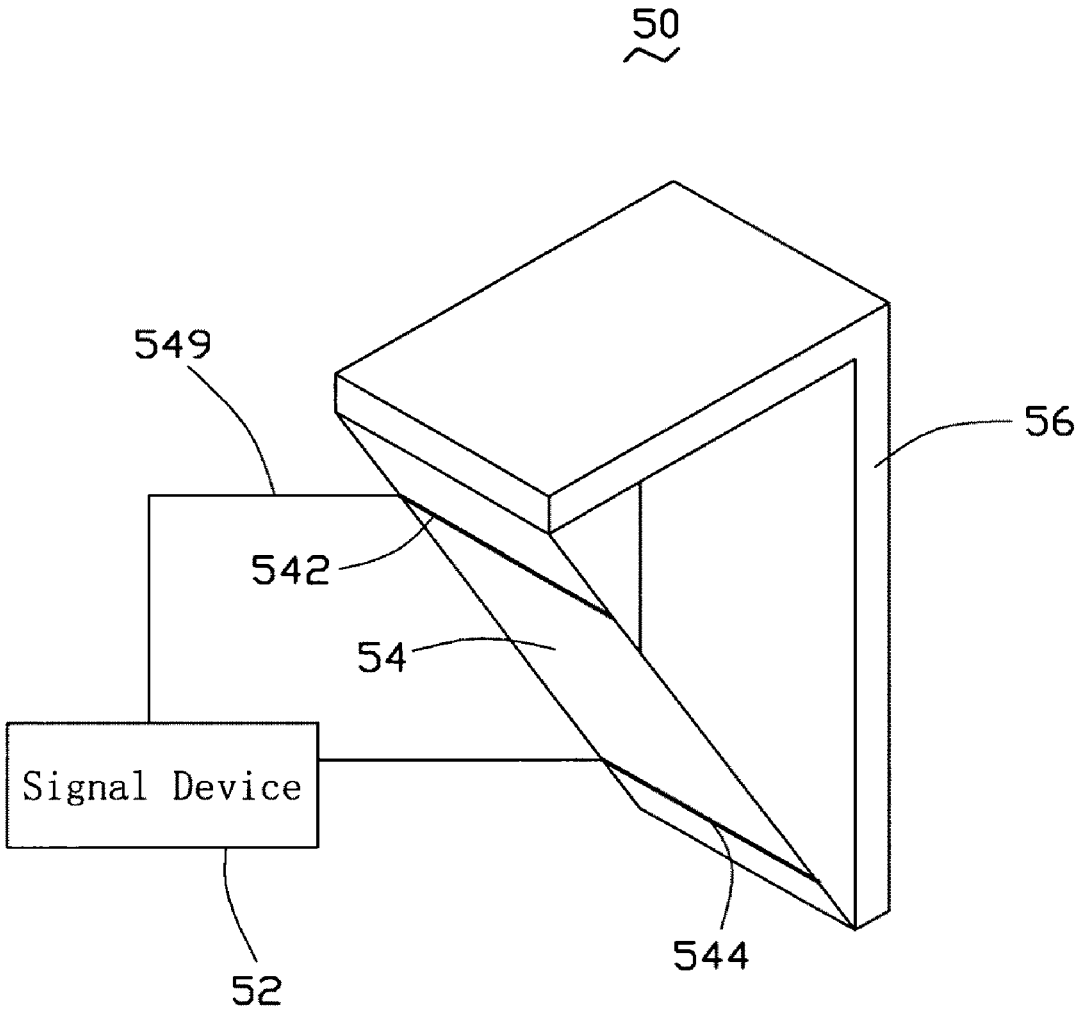
FIG. 16 is a schematic structural view of a thermoacoustic device in accordance with an embodiment.

Referring to FIG. 16, a thermoacoustic device 50 according to an embodiment includes a signal device 52, a sound wave generator 54, a framing element 56, a first electrode 542, and a second electrode 544.

The compositions, features, and functions of the thermoacoustic device 50 in the embodiment shown in FIG. 16 are similar to the thermoacoustic device 30 as shown in FIG. 14. The difference is that a portion of the sound wave generator 54 is located on a surface of the framing element 56 and a sound collection space is defined by the sound wave generator 54 and the framing element 56. The sound collection space can be a closed space or an open space. In the present embodiment, the framing element 56 has an L-shaped structure. In other embodiments, the framing element 56 can have a U-shaped structure or any cavity structure with an opening. The sound wave generator 54 can cover the opening of the framing element 56 to form a Helmholtz resonator. It is to be understood that the sound producing device 50 also can have two or more framing elements 56, the two or more framing elements 56 are used to collectively suspend the sound wave generator 54. A material of the framing element 56 can be selected from suitable materials including wood, plastics, metal and glass. Referring to FIG. 16, the framing element 56 includes a first portion 562 connected at right angles to a second portion 564 to form the L-shaped structure of the framing element 56. The sound wave generator 54 extends from the distal end of the first portion 562 to the distal end of the second portion 564, resulting in a sound collection space defined by the sound wave generator 54 in cooperation with the L-shaped structure of the framing element 56. The first electrode 542 and the second electrode 544 are connected to a surface of the sound wave generator 54. The first electrode 542 and the second electrode 544 are electrically connected to the signal device 52. Sound waves generated by the sound wave generator 54 can be reflected by the inside wall of the framing element 56, thereby enhancing acoustic performance of the thermoacoustic device 50. It is understood that a framing element 56 can take any shape so that carbon nanotube structure is suspended, even if no space is defined. It is understood that the sound wave generator 54 can have a supporting element in any embodiment.

The thermoacoustic devices 10, 20, 30, 40, 50 have many features and advantages. The base structure includes a large amount of nano-scale elements and thereby has a relatively large specific surface area. The layer of conductive material with extremely small thickness covers on the individual nano-scale elements, and thereby forms the conducting structure that has a relatively large specific surface area and relatively small heat capacity per unit area. Thus, the base structure can be insulative and serve to support the layer of conductive material covered thereon. The conducting structure formed by the layer of conductive material solely produces sound by the thermoacoustic effect. The selection of the base structure is extended beyond the carbon nanotube structure. Further, when the carbon nanotube structure is used as the base structure, the carbon nanotube structure and the layer of conductive material covered thereon produce the sound together. The sound wave generator has a lower square resistance and a higher conductivity compared with the pure carbon nanotube structure. Therefore, the layer of conductive material decreases the resistance of the sound wave generator, and thereby decreasing the required driving voltage of the thermoacoustic device.

It is to be understood that the base structure is not limited to the carbon nanotube structure. Other structures composed of nano-scale elements having a large specific surface area and a small heat capacity per unit area can be adopted as the base structure to support the layer of conductive material formed on the individual nano-scale elements, and are in the scope of the invention.

It is to be understood that the above-described embodiments are intended to illustrate rather than limit the invention. Any elements described in accordance with any embodiments is understood that they can be used in addition or substituted in other embodiments. Embodiments can also be used together. Variations may be made to the embodiments without departing from the spirit of the invention. The above-described embodiments illustrate the scope of the invention but do not restrict the scope of the invention.

What is claimed is:

1. A thermoacoustic device comprising:

a signal device; and a sound wave generator, the sound wave generator comprises of a base structure and a conductive material located on at least a portion of the base structure;

wherein the base structure comprises a plurality of nano-scale elements, the signal device is capable of transmitting an electrical signal to the sound wave generator, the sound wave generator is capable of converting the electrical signal into heat; and the heat is capable of being transferred to a medium to cause a thermoacoustic effect, and the nano-scale elements are selected from the group consisting of nanowires, nanotubes, and combinations thereof.

2. The thermoacoustic device of claim 1, wherein heat capacity per unit area of the sound wave generator is less than $2\times10^{-4}$ J/cm$^2$*K.

3. The thermoacoustic device of claim 1, wherein frequency response range of the sound wave generator ranges from about 100 Hz to about 100 KHz.

4. The thermoacoustic device of claim 1, wherein specific surface area of the base structure is above 50 m$^2$/g.

5. The thermoacoustic device of claim 1, wherein the base structure comprises of a carbon nanotube structure.

6. The thermoacoustic device of claim 5, wherein the carbon nanotube structure comprises of at least one carbon nanotube film, at least one carbon nanotube wire, or both at least one carbon nanotube film and at least one carbon nanotube wire.

7. The thermoacoustic device of claim 5, wherein the carbon nanotube structure comprises a plurality of carbon nanotubes joined end-to-end by Van der Waals attractive force.

8. The thermoacoustic device of claim 1, further comprising at least two electrodes, the at least two electrodes are electrically connected to the sound wave generator.

9. The thermoacoustic device of claim 1, wherein the conductive material is located on a surface of each of the plurality of the nano-scale elements of the base structure, and the conductive material forms at least one conducting layer about each of the plurality of nano-scale elements.

10. The thermoacoustic device of claim 9, wherein a thickness of the at least one conducting layer is in a range from about 1 nanometer to about 100 nanometers.

11. The thermoacoustic device of claim 1, wherein the conductive material comprises of a material selected from the group consisting of iron, cobalt, nickel, palladium, titanium, copper, silver, gold, platinum, and combinations thereof.

12. The thermoacoustic device of claim 1, further comprising a supporting element, wherein at least a portion of the sound wave generator is located on a surface of the supporting element.

13. The thermoacoustic device of claim 1, further comprising a framing element, wherein the sound wave generator is supported by the framing element, and at least a portion of the sound wave generator is suspended.

14. A thermoacoustic device comprising:

a sound wave generator, the sound wave generator comprising a base structure and at least one layer of conductive material located on the base structure, and the base structure comprises a plurality of nano-scale elements;

wherein the sound wave generator is capable of converting an electrical signal into heat; and the heat is capable of being transferred to a medium to cause a thermoacoustic effect, the nano-scale elements are selected from a group consisting of nanowires, nanotubes, and combinations thereof.

15. The thermoacoustic device of claim 14, further comprising two electrodes, wherein the nano-scale elements are carbon nanotubes, and the carbon nanotubes are aligned along a direction from the one electrode to the other electrode.

16. The thermoacoustic device of claim 14, wherein the base structure comprises at one carbon nanotube film; the carbon nanotube film comprises a plurality of carbon nanotubes aligned along a same direction and joined end-to-end by Van der Waals attractive force therebetween.

17. The thermoacoustic device of claim 14, wherein a conducting structure is composed by the at least one layer of conductive material, and an electrical signal is conducted in the conducting structure.

18. A thermoacoustic device comprising:

a signal device;

a sound wave generator, the sound wave generator comprising a carbon nanotube structure and at least one layer of conductive material; the carbon nanotube structure comprising a plurality of carbon nanotubes; the at least one layer of conductive material is covered on individual carbon nanotubes of the carbon nanotube structure;

wherein when the signal device transmits an electrical signal to the sound wave generator, the sound wave generator converts the electrical signal into heat, the heat is transferred to a medium, and causes a thermoacoustic effect.

* * * * *